US007219453B2

(12) United States Patent
Baker

(10) Patent No.: US 7,219,453 B2
(45) Date of Patent: May 22, 2007

(54) FLOATDOWN IMPLEMENT FOR SMALL VEHICLES

(76) Inventor: Robert E. Baker, 4164 Country Road 123, Bedford, WY (US) 83112

( * ) Notice: Subject to any disclaimer, the term of this patent is extended or adjusted under 35 U.S.C. 154(b) by 273 days.

(21) Appl. No.: 10/703,045

(22) Filed: Nov. 6, 2003

(65) Prior Publication Data

US 2004/0144002 A1 Jul. 29, 2004

Related U.S. Application Data

(60) Provisional application No. 60/442,463, filed on Jan. 24, 2003.

(51) Int. Cl.
*E01H 5/04* (2006.01)

(52) U.S. Cl. ..... 37/232; 172/817

(58) Field of Classification Search ..... 37/231, 37/232, 234, 235; 172/811, 817, 272, 273
See application file for complete search history.

(56) References Cited

U.S. PATENT DOCUMENTS 4,304,056 A * 12/1981 Watson et al. ..... 37/233
4,421,449 A * 12/1983 Cotton ..... 414/685
4,790,085 A * 12/1988 Rossman ..... 37/231
4,947,563 A * 8/1990 Pfister, Jr. ..... 37/231
5,036,607 A * 8/1991 Taylor ..... 37/444
5,209,002 A * 5/1993 Tranquilli et al. ..... 37/442
5,329,708 A 7/1994 Segorski et al. ..... 37/231
5,538,086 A * 7/1996 Wright et al. ..... 172/272
5,582,502 A * 12/1996 Herin ..... 414/685
5,615,745 A 4/1997 Cross ..... 172/811
5,806,214 A * 9/1998 Behrens et al. ..... 37/231
5,921,010 A * 7/1999 Schulte et al. ..... 37/232
5,950,336 A 9/1999 Liebl ..... 37/231
6,050,008 A * 4/2000 Doornek et al. ..... 37/231
6,088,937 A * 7/2000 DiClementi et al. ..... 37/232
6,941,685 B2 * 9/2005 Goy et al. ..... 37/232

* cited by examiner

*Primary Examiner*—Victor Batson
(74) *Attorney, Agent, or Firm*—Kirton & McConkie; Michael F. Krieger

(57) ABSTRACT

A small vehicle-mounted power assisted implement that employs an independent motor associated with or located on the vehicle. The implement features a floatdown system for applying a continuous bi-directional force to the implement and to the vehicle to improve ground surfacing capabilities and efficiency.

38 Claims, 5 Drawing Sheets

FLOATDOWN IMPLEMENT FOR SMALL VEHICLES

RELATED APPLICATIONS

This application claims priority to U.S. Provisional Patent Application No. 60/442,463 filed Jan. 24, 2003, entitled, "Power Assisted Floatdown Plow for an All-Terrain Vehicle," incorporated herein by reference.

BACKGROUND

1. Field of the Invention

The present invention relates to a vehicle mounted implement, and, more particularly, to an attached or removable floatdown implement capable of being supported by a small vehicle.

2. Background

All terrain vehicles ("ATVs") and other small vehicles are capable of accomplishing otherwise difficult or laborious tasks in a relatively short amount of time. As a result, such vehicles are frequently used in connection with farm work, landscaping, and other such labor-intensive activities.

Accessories capable of being attached to and supported by such vehicles are also known. A removable snow plow, for example, may be mounted to a small vehicle to remove snow and ice from various surfaces, such as driveways, sidewalks, short road segments, parking lots, and other similar relatively limited areas of space that are too small for a full size snow plow to maneuver, yet large enough that shoveling by hand would result in a very labor intensive and time consuming task.

Indeed, the small vehicle-mounted plow has become a popular alternative to shoveling heavy snow and ice by hand for several reasons. First, small vehicles such as ATVs are typically quite maneuverable. Second, the blade on a small vehicle-mounted removable snow plow typically comprises a much larger surface area than hand snow shovels, thus providing greater snow removal capabilities with each pass. Third, the time required to shovel a driveway, sidewalk, parking lot, etc., is significantly reduced, due to the speed, power, and efficiency with which a small vehicle is able to remove snow and ice compared to shoveling by hand. Fourth, there is virtually no physical exertion or energy expended by the operator of a small vehicle, as opposed to a significant amount where shoveling by hand. Fifth, operating a small vehicle is often an enjoyable experience, even if for work related purposes.

Several prior art ATV and other small vehicle-mounted plow designs exist. See, for example, U.S. Pat. No. 5,615,745, U.S. Pat. No. 9,590,336, and U.S. Pat. No. 5,329,708, all incorporated herein by reference. Prior art plow designs are generally mounted to a vehicle using a heavy duty pivotable frame suspended from an underside of the vehicle chassis. The pivotable frame attaches generally below the mid point of the vehicle at a pivot point. This configuration keeps the front end of the vehicle from becoming too heavy for satisfactory operation. A mechanical operating lever is provided to lift the blade off of the ground by rotating the blade about the pivot point. Due in part to the space occupied underneath the vehicle by the plow frame, however, and also due to the cant of the plow blade, the plow blade cannot typically be raised more than 2 or 3 inches off of the ground.

Moreover, many prior art plow designs suffer from the following deficiencies. First, many plow users lack the strength or energy required to manipulate the plow blade in a manually operated system. Second, prior art plow systems are generally difficult to mount and remove from a vehicle. Thus, most users mount the plow to a vehicle at the beginning of the winter plow season and do not remove the plow until the season is over. With the plow installed, the vehicle is virtually useless for any other purpose. Indeed, as discussed above, there is very little clearance under the bottom cutting edge of the plow blade even when the blade is completely lifted. There is also very little clearance under the chassis of the vehicle due to the presence of the mounting frame beneath the chassis. Further, the weight of the plow substantially alters the maneuverability of the vehicle to which it is attached.

Another drawback to prior art systems is that many small vehicles, especially ATVs, are relatively light in weight (e.g., lighter ATVs range from about 450 lbs. to 600 lbs. in total weight not including the weight of the plow). Such vehicles thus tend to be underpowered or lack sufficient traction to move large quantities of snow.

Another problem associated with prior art plow designs is blade floating, which results in irregular and/or uneven ground surfacing. Also, blade floating leaves behind residual snow and ice deposits, which may build up and create slush and other problems once warmer weather arrives. Adding weight to the blade of the plow helps reduce floating, but requires the vehicle to work harder and lose critical traction. When the blade is forced down under added weight, the vehicle has a much more difficult time pushing the blade and gripping the surface, effectively negating any efficiency in blade leveling that may otherwise have been gained. Moreover, many plow designs incorporate a spring loaded blade that, upon contact with an immovable object, pivots or rotates so that the top of the plow moves forward while the bottom of the blade rides up over the object. During the period the blade is pivoted, however, the bottom edge of the plow loses contact with the ground, thus forming a residual ridge of snow and ice. A secondary effect of such a ridge is that as the tires of the vehicle cross the ridge, the vehicle is lifted up over the ridge, often causing the plow to temporarily leave the ground. This may result in the formation of a second, smaller ridge. Once the object is cleared, the spring causes the blade to abruptly snap back into position, thus contributing to further leveling and/or floating problems.

Another disadvantage to traditional plow systems, particularly to V-plow systems where a pair of plow blades is connected along a vertical hinge, is that it is difficult to maintain the bottom cutting edge of the plow blade flush with the ground surface unless the plow is precisely mounted on the vehicle and the plow blades are accurately positioned to align the bottom cutting edge flush with the ground. In addition, it is difficult or even impossible to provide evenly distributed downward pressure to a V-blade plow as the bottom cutting edge of the V-plow does not in general remain flush with the ground surface when rotated downward.

Although an operator-controlled actuator mechanism that provides power to an electric actuator to raise and lower the plow may overcome some of these deficiencies, prior art designs that incorporate such a mechanism nevertheless suffer from certain inherent problems. Namely, electrically powered plow designs in the prior art tend to add a significant amount of weight to the plow as a result of requiring a proprietary motor. Also, the incorporation of such a motor renders the plow much more expensive than a manually operated plow.

Accordingly, what is needed is an implement capable of quick and easy installation and removal from a small vehicle. Also what is needed is a small vehicle-mounted implement that is easily operated, and that optimizes efficiency in implement performance. Further what is needed is a small vehicle-mounted plow that may be electrically powered without incurring substantial additional weight and expense.

SUMMARY AND OBJECTS OF THE INVENTION

The present invention comprises a floatdown implement capable of being mounted to and supported by a small vehicle, such as an all terrain vehicle ("ATV"), garden tractor, small farm tractor or small pickup truck. A floatdown implement in accordance with the present invention maximizes the implement's ground surfacing capabilities by incorporating a floatdown member to apply a substantially downward force to the implement while, in some embodiments, lifting weight from the end of the vehicle to which it is mounted.

Specifically, in selected embodiments, a floatdown implement in accordance with the present invention may comprise a spring loaded shock absorber having a dampening element. One end of the shock absorber may be attached to the vehicle while an opposite end is attached to the implement. The shock absorber functions to provide a continuous adjustable downward force to the implement to improve responsiveness to surface characteristics, thereby promoting efficient surface treatment.

According to certain embodiments of the present invention, the implement may utilize a power assist system to promote quick and efficient surface treatment. Specifically, the present invention may incorporate a winch mounted to a vehicle, wherein a cable extends from the winch and attaches to a portion of the implement. The winch may also comprise an actuator that allows the winch to be actuated. The winch functions to provide powered raising and lowering of the implement as desired. Manual lifting and implement manipulation assemblies are also contemplated for use herein.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

As used in this specification, the term "implement" refers to a device for performing work that may be mounted to and supported by a small vehicle, including a snow or dirt plow, a tiller, an S-tine cultivator, a field cultivator, a row crop cultivator, a fertilizer applicator, a hay rake, a ditcher, or any other such device known to those in the art. The term "small vehicle" refers to an all terrain vehicle ("ATV"), garden tractor, small farm tractor, small pickup truck, or any other such vehicle known to those in the art.

Although this detailed description of the present invention primarily focuses on a front-loaded or front-mounted implement system, the present invention may also be applied to implements designed to be pulled behind a small vehicle, such as a drag plow for leveling dirt. One ordinarily skilled in the art will recognize the many applications to which the present invention technology may be adapted and implemented.

A floatdown implement in accordance with the present invention may comprise an implement 50, a floatdown member 82, a power assist assembly 70, and an inline device 110.

Figure 1:
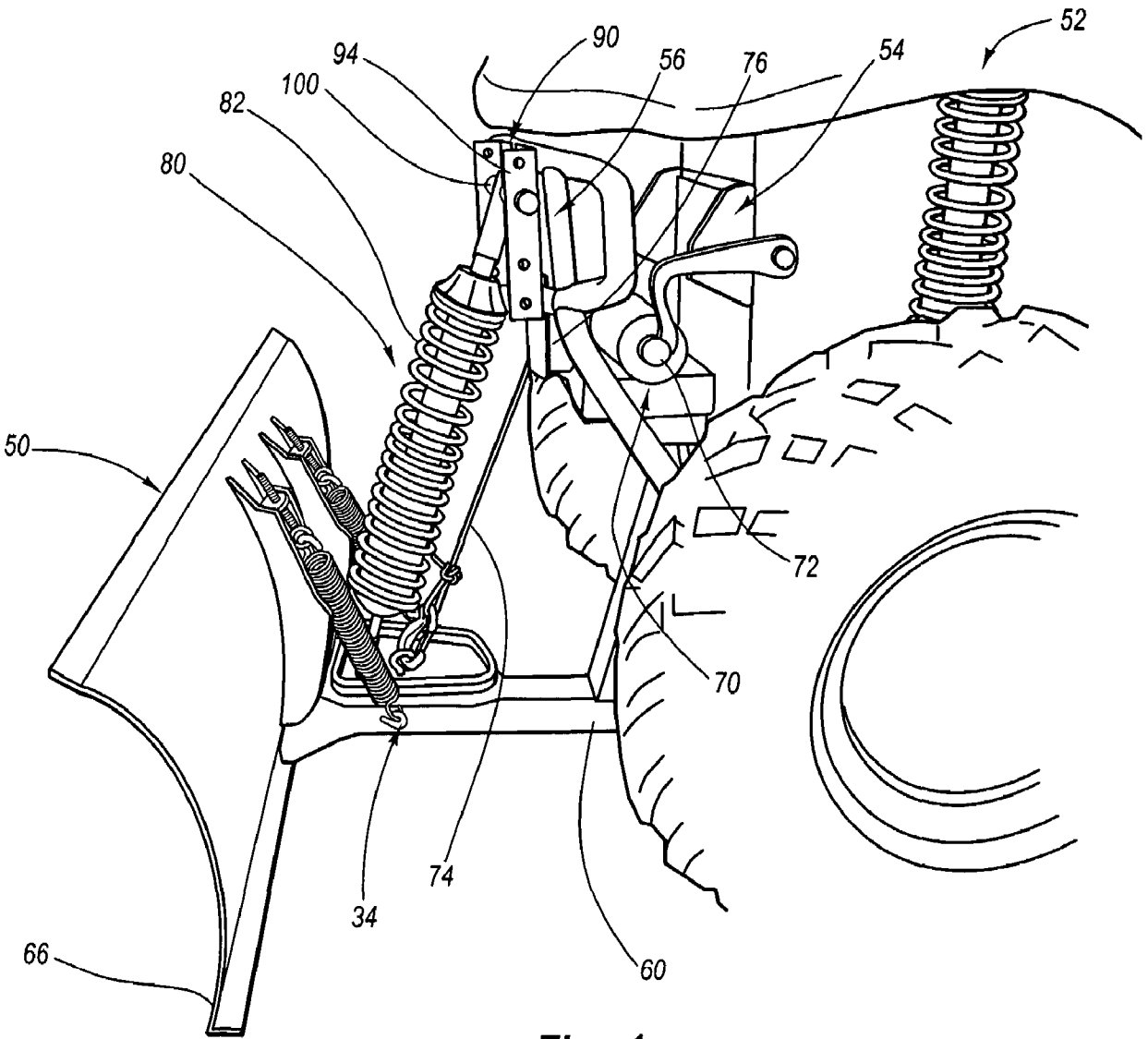
FIG. 1 illustrates a side perspective view of a small vehicle-mounted power-assisted floatdown implement in accordance with selected embodiments of the present invention.
Figure 2:
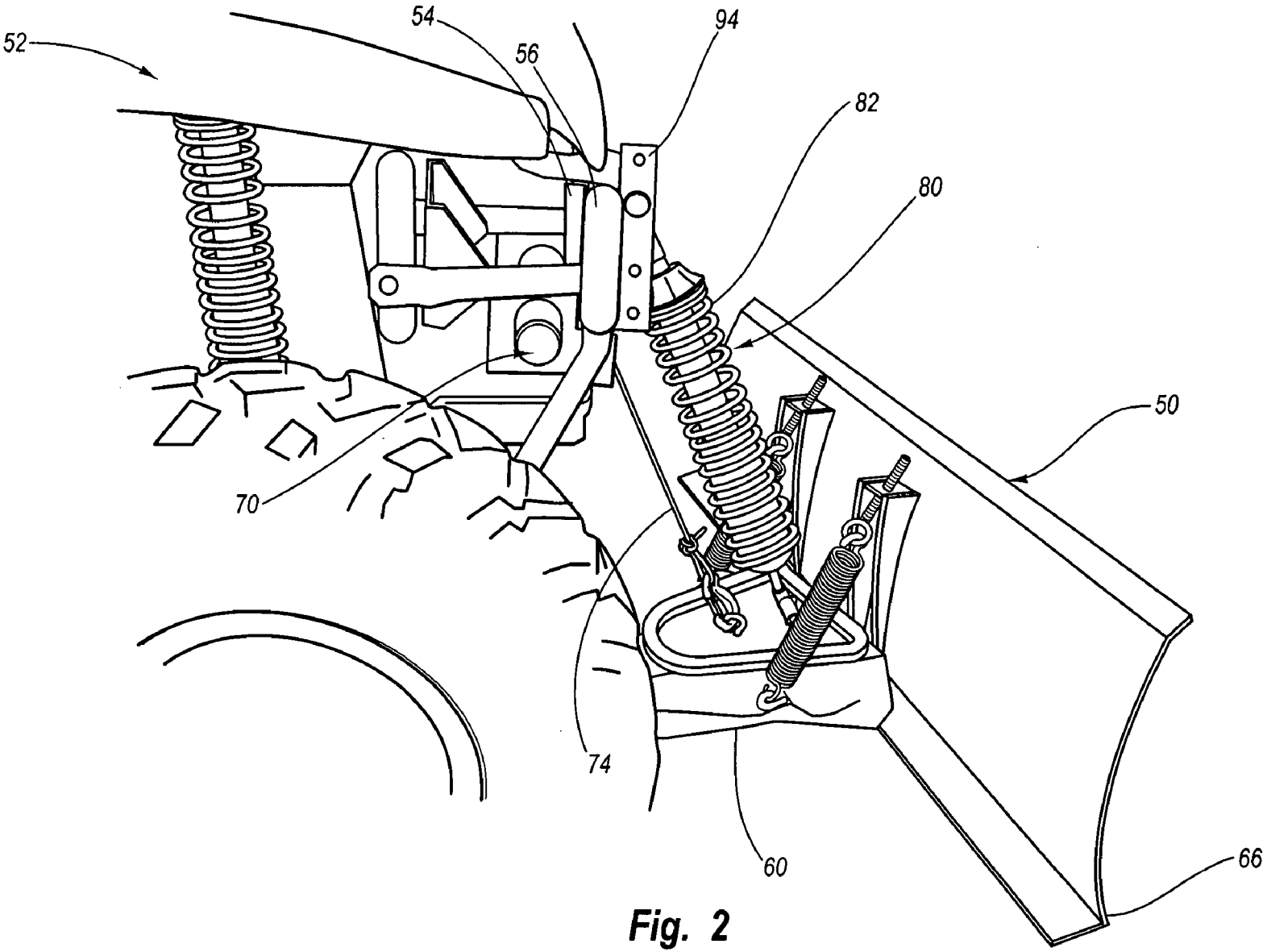
FIG. 2 illustrates an opposite side perspective view of the small vehicle-mounted power-assisted floatdown implement of FIG. 1.

Referring now to FIGS. 1 and 2, an implement 50 may comprise any device for performing work that may be mounted to and supported by a small vehicle 52, including a snow or dirt plow, a farm implement such as a tiller, an S-tine cultivator, a field cultivator, a row crop cultivator, a fertilizer applicator, a hay rake, a ditcher, a drag rake, a heavy brush cutter, or any other such device known to those in the art. An implement 50 comprises at least one operative portion 66 capable of administering a surface treatment to land. For example, an operative portion 66 may comprise a cutting edge, a raking portion, an applicator portion, or any other surface treatment portion known to those in the art capable of applying a particular surface treatment to land.

An implement 50 as described above may be attached to a vehicle 52 by way of any means of attachment known to those in the art. In selected embodiments, such as those depicted in FIGS. 1 and 2, an implement 50 may comprise a push tube 60 extending from a front end of a vehicle 52. The push tube 60 may be mounted to the vehicle 52 by any means known to those in the art. Preferably, a push tube 60 may be easily attached and detached from the vehicle 52 as desired to facilitate quick and easy implementation of the present invention.

Figure 5:
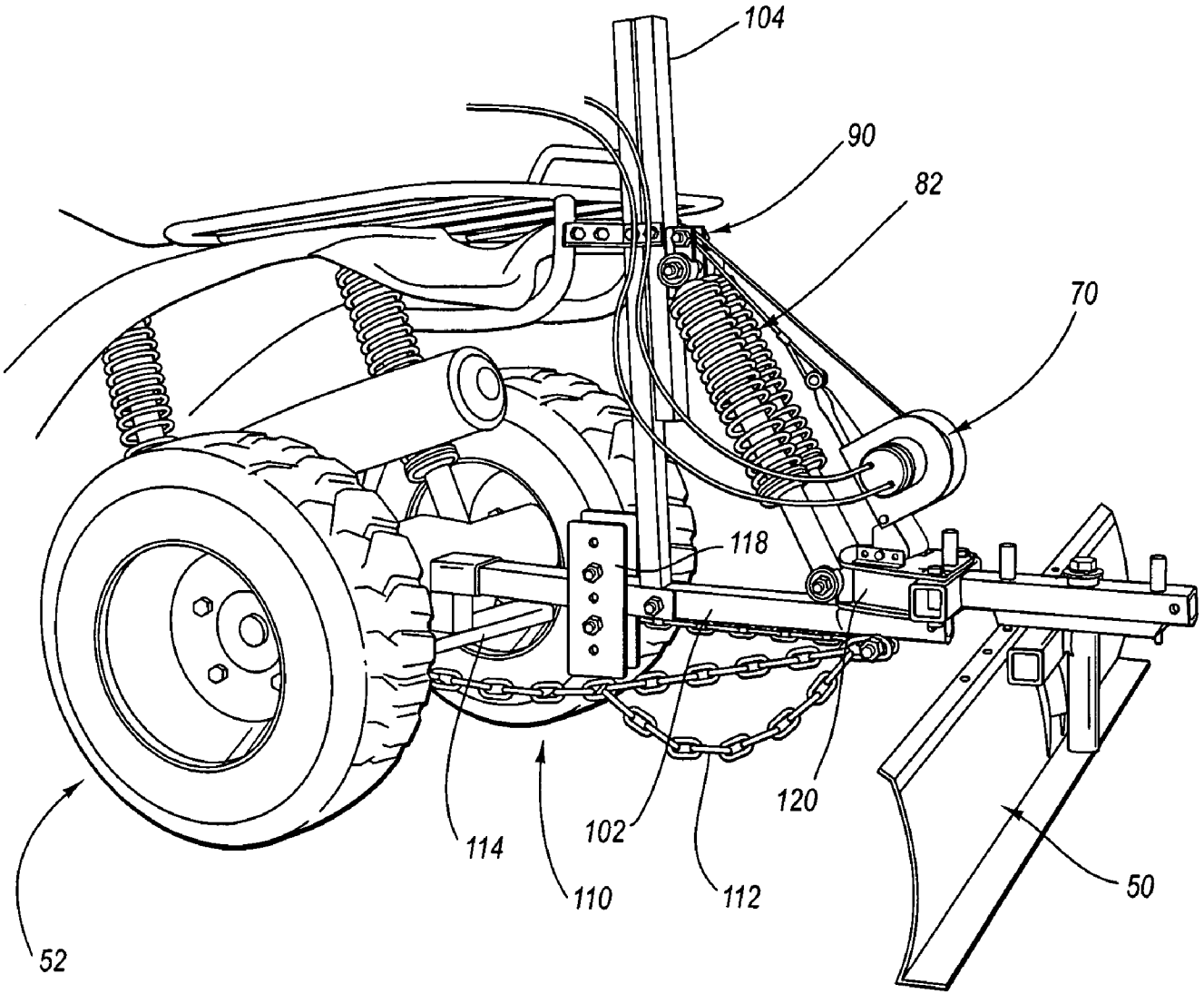
FIG. 5 depicts a perspective view of the small vehicle-mounted floatdown implement attached to a rear end of a small vehicle in accordance with certain embodiments of the present invention.

In alternative embodiments of the present invention, such as that depicted by FIG. 5, an implement 50 may comprise a drawbar 102 attached to a rear end of the vehicle 52. Preferably, a drawbar 102 may be adjusted both to accommodate a variety of small vehicles 52 having various dimensions, as well as to ensure that the drawbar 102 is retained substantially parallel to a surface during surface treatment.

A drawbar 102 may comprise, for example, adjustment means 118 intermediate the length of the drawbar 102 for enabling selective adjustment of the height of the drawbar 102 and implement 50 relative to a particular vehicle 52.

A vertical bar 104 may be implemented in connection with the drawbar 102 disclosed above to secure the drawbar 102 position as well as to provide a downward force against the implement 50. In addition, the vertical bar 104 may provide a point of attachment for a power assist system 70, as discussed below.

Specifically, one end of a vertical bar 104 may be pivotally attached to the drawbar 102 such that the drawbar 102 is constrained from rotating from side to side such that the implement 50 may be thereby maintained substantially parallel to the ground surface. A second end of a vertical bar 104 may be loosely or solidly attached to a small vehicle 52 such that when the implement 50 is in a down position, the vertical bar 104 exerts a forward force against the vehicle 52 to prevent the vehicle 52 from becoming unbalanced. When the implement is in an up position, the vertical bar 104 may be held substantially adjacent the vehicle 52.

As mentioned above, a vertical bar 104 may also provide a point of attachment for a power assist system 70. Specifically, a pulley may be coupled to the vertical bar 104 to facilitate parting a winch line, where a winch provides assisted power to the implement 50. Alternatively, any other portion of a power assist system 70 known to those in the art may be attached to the vertical bar 104 to facilitate power assist system operation.

Figure 3:
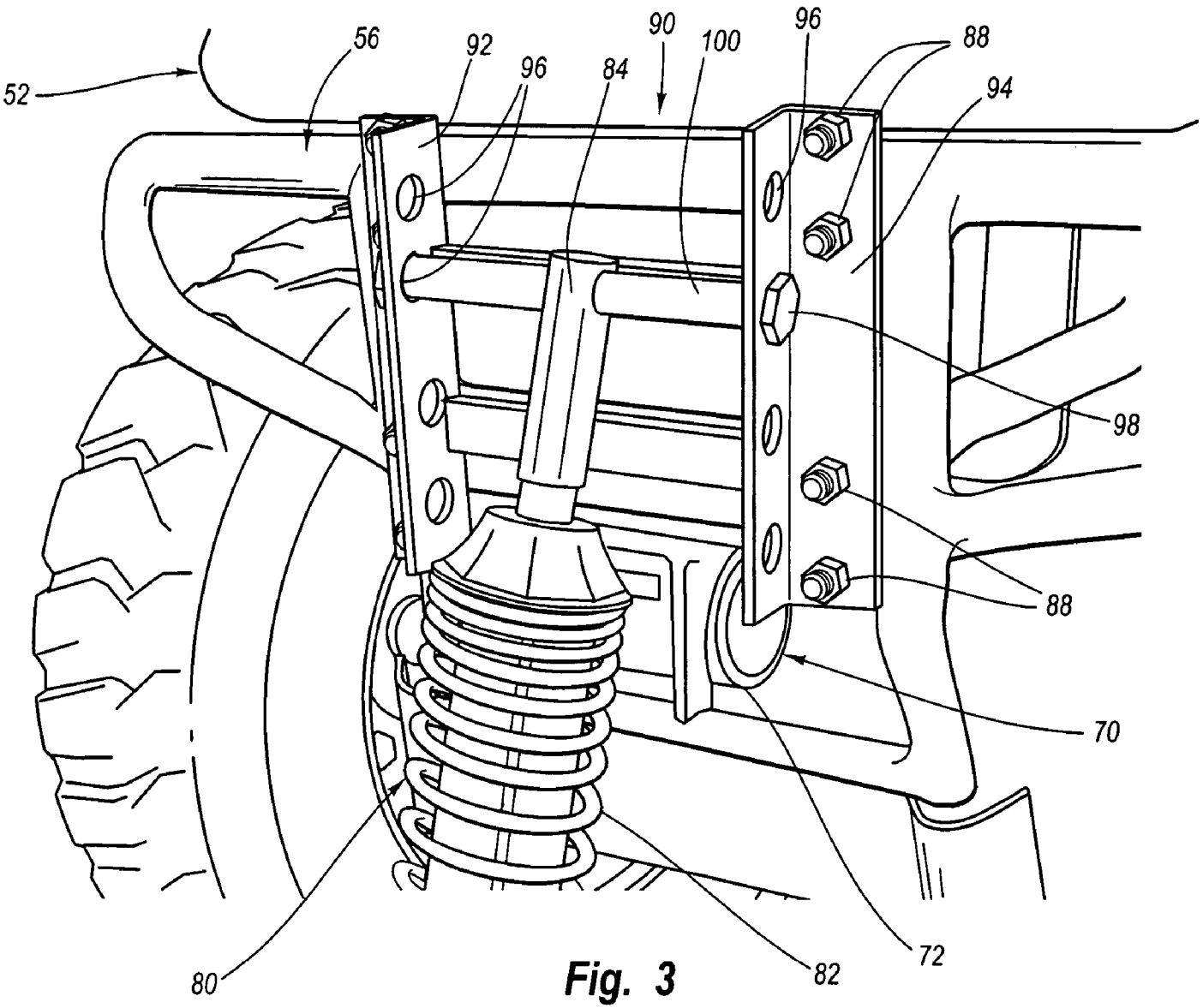
FIG. 3 illustrates a detailed view of a floatdown member and a power assist system attached to a small vehicle in accordance with certain embodiments of the present invention.
Figure 4:
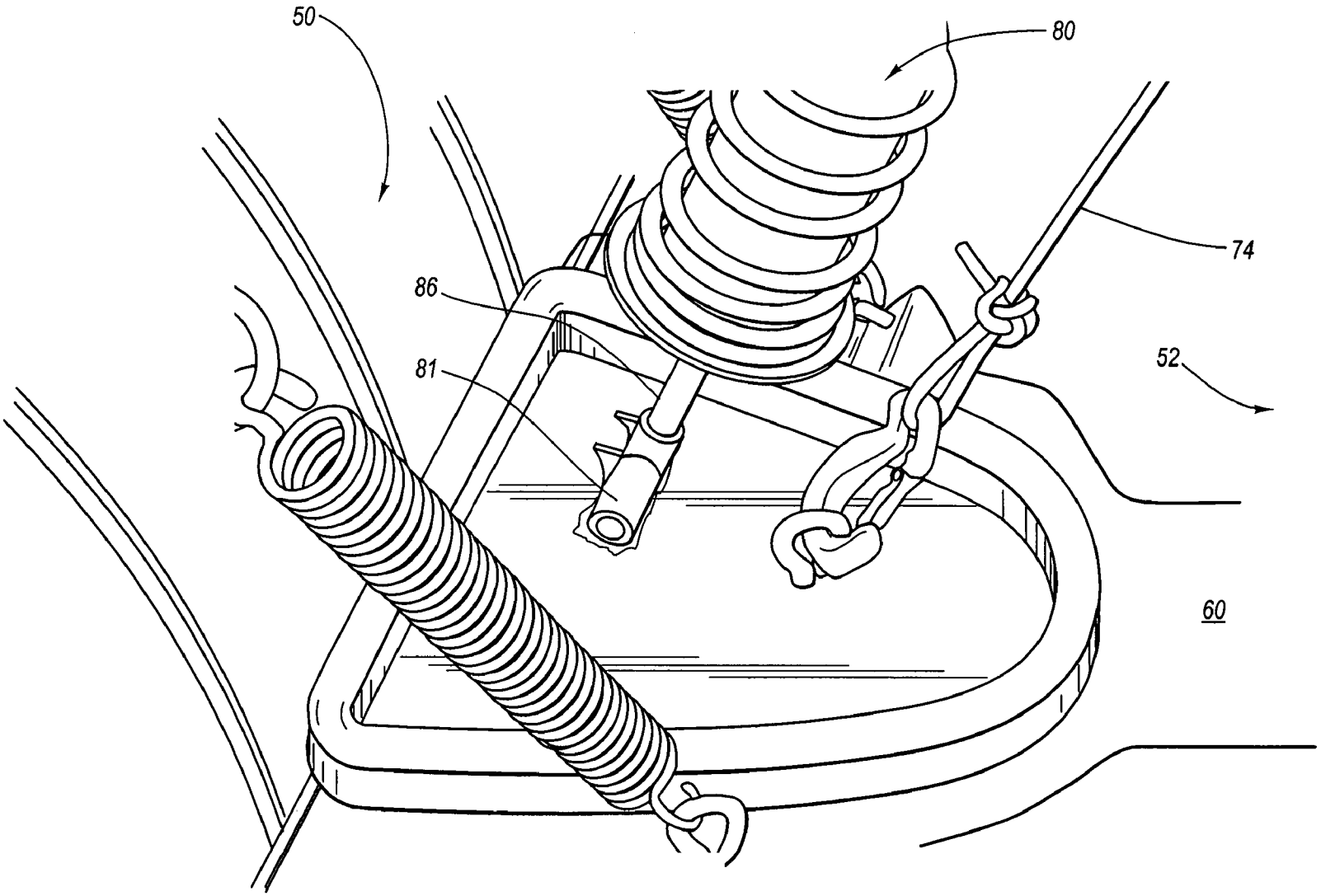
FIG. 4 illustrates a detailed view of a floatdown member attached to an implement in accordance with the present invention.

Referring now to FIGS. 3 and 4, the present invention may further comprise a means for applying a downward force to the implement 50, as indicated above. Specifically, a floatdown member 82 may apply substantially downward force to the implement 50 without adding substantial weight to or otherwise unbalancing the vehicle 52 to which it is attached. As a result, a floatdown member 82 may both reduce the tendency of the implement 50 to float, as well as facilitate improved surfacing capabilities of the implement 50 in operation. The floatdown member 82 of the present invention also functions to provide added stability to an attached implement 50.

Indeed, because of its unique design, implement floating is significantly reduced or kept to a minimum and more even and consistent leveling is achieved. Also, as a floatdown member 82 in accordance with the present invention may be adjusted or may self-adjust to surface characteristics, varying degrees of force may be transferred from the floatdown member 82 to the implement 50, depending upon the particular circumstances or environment of use.

In selected embodiments of the present invention, such as that depicted in FIGS. 3 and 4, a floatdown member 82 may comprise a spring-loaded shock absorber having adjustable dampening characteristics. This particular type of float down member 82 is easily adapted for use with an implement 50 and provides an advantage in that it slows or dampens the up and down action of implement 50 during operation. This feature facilitates surfacing capabilities as implement 50 floating potential is thereby effectively reduced. Moreover, the dampening characteristics of this particular type of float down member 82 significantly improves the ability and function of the implement 50 when operated over uneven terrain, immovable objects, or in other cases that may induce undesirable implement 50 movement. Indeed, the float down member 82 allows the implement 50 to absorb shocks and handle abrupt changes in terrain very efficiently.

Alternatively, a floatdown member 82 may comprise any biasing, hydraulic, pneumatic, or mechanical member, or combination thereof, capable of maximizing implement 50 responsiveness and function while minimizing a likelihood of shock. Specifically, a floatdown member 82 may comprise a coil spring, an air bag, and/or an electrically operated screw. This list is not meant to be limiting in any way as one ordinarily skilled in the art will recognize that other systems, devices or means not specifically recited herein may also be used to accomplish the intended functions as described herein.

A floatdown implement in accordance with the present invention may be coupled to a front or rear end of an ATV or other small vehicle 52. A small vehicle 52 preferably comprises a front grill 56, wherein attachment means 90 may be used to couple the floatdown member 82 to the vehicle's front grill 56. By way of example and not limitation, attachment means 90 may comprise a first L-shaped bracket 92 and a second L-shaped bracket 94 coupled to the front grill 56. First and second L-shaped brackets 92 and 94 may be positioned apart and opposite one another on front grill 56 and may implement a crossbar 100 therebetween. The crossbar 100 may be pivotally coupled to each of the first and second L-shaped brackets 92 and 94 such that the floatdown member 82 attached thereto may also pivot with respect to the brackets 92 and 94.

As illustrated in FIG. 3, first and second L-shaped brackets 92 and 94 may be attached in an opposing manner on front grill 56 of vehicle 52. Each of first and second L-shaped brackets 92 and 94 may further comprise a plurality of apertures 96 spaced along their length, where at least one aperture 96 of the first L-shaped bracket 92 preferably corresponds to an aperture 96 of the second L-shaped bracket 94. Apertures 96 provide adjustability to floatdown member 82 in that crossbar 100 may be inserted into any set of apertures 96 as necessary to optimize the operation of floatdown member 82 and implement 50. Indeed, in this manner, the downward pressure of floatdown member 82 may be adjusted as needed by moving crossbar 100 up or down such that crossbar 100 may attach to a specific set of apertures 96 on either L-shaped bracket 92 and 94.

First and second L-shaped brackets 92 and 94 may be attached to front grill 56 using attachment means 88. Attachment means 88 are shown as a curved bolt assembly, but may comprise any attachment means commonly known in the art. Moreover, crossbar 100 is shown as extending between and attaching to first and second L-shaped brackets 92 and 94 using attachment means 98. Attachment means 98 is shown as a bolt structure, but as noted, may also be any attachment means commonly known in the art.

A float down member 82 may comprise an upper segment 84 that pivotally attaches directly to crossbar 100, preferably at a center point of the crossbar 100. The pivoting motion of float down member 82 is provided in order to accommodate and correspond to the lifting and lowering of implement 50.

A lower segment 86 of float down member 82 may be attached to implement 50 via attachment means 81, as illustrated in FIG. 4. Attachment means 81 preferably enables the lower segment 86 to also pivot, similar to attachment means corresponding to upper segment 84 above. In this manner, floatdown member 82 may further increase responsiveness of implement 50 to surface characteristics. It should be noted, however, that one, both, or neither of upper and lower segments 84 and 86 may be pivotable with respect to vehicle 52 and implement 50.

In addition, a floatdown member 82 preferably comprises a dampening element that effectively slows the response time of an attached implement 50. Providing a dampening element essentially allows the implement 50 to smoothly and effortlessly adjust or respond to various objects and/or uneven terrain encountered during surface treatment.

Each of the above described advantages relating to the floatdown member 82 function to create a more efficient and effective implement system. By reducing implement floating, increasing implement leveling capabilities, improving implement responsiveness, and slowing the reaction of the implement to various objects and terrain, the implement system of the present invention may provide more efficient ground surfacing and application of surface treatments, reduce the time required to complete a ground surface related job, and reduce shock and shock related damage.

A floatdown member 82 may be adapted for use with any existing implement 50, regardless of whether a power assist assembly 70 or equivalent structure is implemented. Moreover, a floatdown member 82 in accordance with the present invention is not limited to ATVs and other small vehicles, but may be adapted for use with larger vehicles.

As discussed above, a third aspect of the present invention may comprise a means to provide assisted power to raise and lower the implement 50. Specifically, a power assist system 70 may be operatively coupled to the implement 50 such that the implement 50 may be effectively controlled thereby.

The present invention contemplates utilizing any type of self-powered motor that currently exists or is associated with a vehicle 52. In selected embodiments, a power assist system 70 comprises a winch 72 having a fairlead 76 and a cable 74 attached thereto to provide power for assisting in the operation of the implement 50. The cable 74 may extend from a fairlead 76 down to a point of attachment on implement 50. The winch 72 may be mounted on a vehicle 52 by any means known to those in the art. Preferably, the winch 72 is mounted either behind or above the floatdown member 82. Winch 72 should also be mounted so that there is no obstruction or interference between it, or particularly its attached cable 74, and any component of an implement 50 attached to the vehicle 52.

A winch 72 may comprise a user actuator module (not shown) that is positioned near the user to actuate winch 72 as desired. Essentially, winch 72 functions to provide automatic or powered lifting and lowering capabilities to implement 50. As the user sits atop vehicle 52, the implement 50 may be lifted and lowered as desired via the actuation module of winch 72 at the user's fingertips. To lift implement 50, the user simply activates the winch 72 to reel in cable 74. Since one end of cable 74 is attached to implement 50, this motion causes implement 50 to be lifted off of the ground. Likewise, to lower the implement 50, the user simply activates winch 72 to let out cable 74, thereby lowering the implement 50 to the ground.

FIG. 4 illustrates an attachment assembly that may be used to attach cable 74 to implement 50. As shown, cable 74 comprises a hook at one end that attaches to an eye screw securely fastened to implement 50, although any means of attachment capable of securely attaching cable 74 to implement 50 known to those in the art is contemplated within the scope of the present invention. Indeed, one ordinarily skilled in the art will recognize several different means and methods of attaching cable 74 to implement 50, and therefore the embodiment shown in FIG. 4 is merely exemplary and not intended to be limiting in any way.

As the power assist system 70 of the present invention does not require any proprietary power source, the present invention may remain affordable without compromising efficiency. In addition, the power assist system 70 of the present invention may be adapted to transition an otherwise manual implement to a power assisted implement with a minimal degree of effort and cost.

According to certain embodiments of the present invention, the power assist system 70 may be integral to or capable of being integrated with the floatdown member 82 discussed above. For example, a hydraulic device such as a hydraulic ram may be implemented to function as a floatdown member 82 capable of providing assisted power to lift the attached implement 50 as desired. Similarly, a coil spring or other biasing means may be used in combination with a hydraulic or other power assist system 70 such that the implement 50 may be powered up and down by the power assist system 70 while the biasing means applies a continuous downward force thereto. While the foregoing is exemplary and not restrictive, one skilled in the art will recognize that many combinations of a power assist system and floatdown member are contemplated as within the scope of the present invention.

According to another aspect of the present invention, as depicted in FIG. 5, an inline device 110 may be implemented to maintain a centered relationship between the implement 50 and the vehicle 52 to which it is attached. An inline device 110 may comprise, for example, two or more leads 112, each having one end attached to the vehicle 52 and one end attached to the implement 50. Preferably, neighboring leads 112 are separated by a spreader bar 114 located substantially adjacent the vehicle 52 to reduce strain on the leads 112. A lead 112 may comprise any flexible or inflexible material capable of being attached to each of a vehicle 52 and an implement 50 to maintain a substantially centered relationship therebetween. A lead 112 may comprise, for example, a chain, a rope, a metal bar, or any other such device known to those in the art.

Again referring to FIG. 5, an adapter member 120 may be provided to integrate the functions of the implement 50, drawbar 102 or push tube 60, floatdown member 82, power assist assembly 70, and inline device 110. An adapter member 120 in accordance with certain embodiments of the present invention may be adjustable such that the adapter member 120 may be secured at various attachment points along a drawbar 102, push tube 60, or other portion of an implement 50 to accomplish various specific purposes, and, depending on the purpose for which the adapter member 120 is used, any or all of the following devices may, but need not, be attached thereto: implement 50, drawbar 102 or push tube 60, floatdown member 82, power assist assembly 70, and inline device 110. Alternatively, an adapter member 120 may be fixedly attached to a drawbar 102 or push tube 60, or to any other device at a location between the vehicle 52 and the implement 50. In addition, an adapter member 120 may be attached to or used in connection with any other device known to those in the art to facilitate implement operation.

In certain embodiments of the present invention, an additional set of leads 112 may be implemented between the adapter member 120 and a spreader bar 114 to further ensure a substantially centered relationship between the vehicle 52 and an implement 50.

What is claimed and desired to be secured by Letters Patent is:

1. A floatdown implement for applying a surface treatment to land, wherein said floatdown implement is capable of being mounted to and supported by a small vehicle, said floatdown implement comprising:

an implement having at least one portion capable of administering said surface treatment to land;

a bracket directly fixedly coupled to said small vehicle at a point located above said implement when said implement is in an operating position;

a substantially-horizontal member directly connected to said small vehicle and also directly connected to said implement, wherein the substantially-horizontal member is in a position substantially parallel to a surface receiving said surface treatment when said implement is in an operating position; and a floatdown member applying a continuous downward force to said implement;

wherein a first end of said floatdown member is directly connected to said bracket and a second end of said floatdown member is directly connected to said substantially-horizontal member at a point proximal said implement; and wherein said floatdown member is disposed between said implement and said small vehicle and wherein said floatdown member includes a dampening element.

2. The floatdown implement of claim 1, wherein said implement is selected from the group consisting of a snow plow, a farm implement and a dirt working device.

3. The floatdown implement of claim 1, further comprising means for attaching said floatdown member to said vehicle.

4. The floatdown implement of claim 3, wherein said means for attaching said floatdown member to said vehicle comprises an attachment assembly having a crossbar substantially perpendicularly retained between at least two brackets, wherein said attachment assembly is mounted to said vehicle.

5. The floatdown implement of claim 1, wherein said floatdown member is selected from the group consisting of a coil over shock absorber, a spring, a pneumatic device, and a hydraulic device.

6. The floatdown implement of claim 1, further comprising means for providing assisted power to raise and lower said implement.

7. The floatdown implement of claim 6, wherein said means for providing assisted power is integrated into said floatdown member.

8. The floatdown implement of claim 6, wherein said means for providing assisted power is coupled to said vehicle.

9. The floatdown implement of claim 6, wherein said means for providing assisted power is selected from the group consisting of a winch, a hydraulic device, a pneumatic device, a magnetic device and a mechanical device.

10. The floatdown implement of claim 1, further comprising an inline device for maintaining a centered relationship between said implement and said vehicle.

11. The floatdown implement of claim 10, wherein said inline device comprises a plurality of chains disposed between said implement and said vehicle.

12. The floatdown device of claim 11, wherein said inline device further comprises a spreader bar coupled to said vehicle to reduce strain on said plurality of chains.

13. The floatdown device of claim 1, further comprising an adapter member disposed between said implement and said small vehicle.

14. The floatdown implement of claim 13, wherein said adapter member is coupled to means for attaching said floatdown member to said vehicle.

15. The floatdown implement of claim 13, wherein said adapter member is capable of being selectively adjusted.

16. A power-assisted implement system comprising:

a small vehicle capable of supporting an implement;

a removable power-assisted implement mounted to said small vehicle, said removable power-assisted implement comprising:

a floatdown member disposed between said small vehicle and said implement and applying a continuous downward force to said implement, wherein:

a first end of said floatdown member is directly connected to said small vehicle at a bracket located at a point located above said implement when said implement is in an operating position;

a second end of said floatdown member is directly connected to a substantially-horizontal member at a point proximal said implement, said substantially-horizontal member being directly connected to said implement and said small vehicle and assuming a position substantially parallel to a surface receiving said implement in said operating position; and said floatdown member includes a dampening element; and a power assist assembly operatively connected to said implement for providing assisted power to lift and lower said implement from and to said operating position.

17. The power-assisted implement system of claim 16, further comprising means for attaching said floatdown member to said small vehicle.

18. The power-assisted implement system of claim 17, wherein said means for attaching said floatdown member to said small vehicle comprises an attachment assembly having a crossbar substantially perpendicularly retained between at least two brackets, wherein said attachment assembly is mounted to said vehicle.

19. The power-assisted implement system of claim 18, wherein said attachment assembly further comprises an adapter member adjustably coupled thereto.

20. The power-assisted implement system of claim 19, wherein said adapter member is further coupled to at least one of the group consisting of said implement, said floatdown member, said power assist assembly and an inline device.

21. The power-assisted implement system of claim 18, wherein said floatdown member may be pivotally attached to said crossbar.

22. The power-assisted implement system of claim 16, wherein said implement is selected from the group consisting of a snow plow, a farm implement, and a dirt working device.

23. The power-assisted implement system of claim 16, wherein said floatdown member is selected from the group consisting of a biasing device, a pneumatic device, and a hydraulic device.

24. The power-assisted implement system of claim 23, wherein said floatdown member further comprises a shock absorbing element.

25. The power-assisted implement system of claim 16, wherein said power assist assembly is coupled to said vehicle.

26. The power-assisted implement system of claim 16, wherein said power assist assembly is integral to said floatdown member.

27. The power-assisted implement system of claim 16, wherein said power assist assembly comprises a winch having a fairlead and a cable, wherein said cable is operatively attached to said implement.

28. The power-assisted implement system of claim 16, wherein said power assist system is selected from the group consisting of a hydraulic device, a pneumatic device, a magnetic device and a mechanical device.

29. The power-assisted implement system of claim 16, further comprising an inline device for maintaining a centered relationship between said implement and said vehicle.

30. The floatdown implement of claim 29, wherein said inline device comprises a plurality of leads disposed between said implement and said vehicle.

31. The floatdown device of claim 30, wherein said inline device further comprises a spreader bar disposed between said plurality of leads.

32. The floatdown device of claim 30, wherein said leads comprise chains.

33. A method for applying a surface treatment to land comprising the steps of:

mounting to a small vehicle a removable implement, said mounting comprising:

attaching a first end of a substantially-horizontal member to said implement; and removably attaching a second end of said substantially-horizontal member to a lower portion of said small vehicle;

disposing between said small vehicle and said implement a floatdown member, wherein said floatdown member applies a continuous downward force to said implement and wherein said floatdown member includes a dampening element, said disposing comprising:

attaching a first end of said floatdown member directly to said substantially-horizontal member; and removably attaching a second end of said floatdown member directly to an upper portion of said small vehicle, said upper portion being located at a position above the attachment point of said horizontal member to said implement when said implement is in an operating position;

operatively coupling a power assist assembly to said implement; and applying, with said implement, said surface treatment to land.

34. The method of claim 33, further comprising actuating said power assist assembly to lower said implement to an appropriate level.

35. The method of claim 33, wherein said substantially-horizontal member is a push bar and said mounting further comprises attaching said push bar to an end of said small vehicle and removably coupling to said push bar said implement.

36. The method of claim 33, wherein said disposing further comprises mounting an attachment assembly to said small vehicle, wherein said floatdown member is pivotally attached to said attachment assembly.

37. The method of claim 33, wherein said operatively coupling further comprises integrating said power assist assembly with said floatdown member.

38. The method of claim 33, wherein said operatively coupling further comprises mounting at least a portion of said power assist assembly to said small vehicle.

* * * * *